United States Patent [19]

Miyaoka et al.

[11] 3,954,446

[45] May 4, 1976

[54] METHOD OF PRODUCING HIGH DUTY CAST IRON

[75] Inventors: Tadashi Miyaoka, Nishinomiya; Hiromu Tanimura, Fukuoka; Yoshio Tanaka, Takarazuka; Susumu Togawa, Amagasaki, all of Japan

[73] Assignee: Kubota Ltd., Osaka, Japan

[22] Filed: Jan. 8, 1975

[21] Appl. No.: 539,314

[30] Foreign Application Priority Data

Feb. 23, 1974 Japan ..... 49-21669

[52] U.S. Cl. ..... 75/53; 75/10 R; 75/58

[51] Int. Cl.[2] ..... C21C 7/02; C22B 4/00

[58] Field of Search ..... 75/53, 58, 10, 130 R, 75/130 A

[56] References Cited

UNITED STATES PATENTS

| | | | |
|---|---|---|---|
| 2,757,082 | 7/1956 | Busby | 75/130 R |
| 3,197,306 | 7/1965 | Osborn | 75/53 |
| 3,415,642 | 12/1968 | Matsumoto | 75/130 R |
| 3,598,573 | 8/1971 | Freissmuth | 75/53 |
| 3,622,302 | 11/1971 | Hayashi | 75/58 |
| 3,765,875 | 10/1973 | Septier | 75/130 R |
| 3,769,004 | 10/1973 | Barnhardt | 75/58 |

*Primary Examiner*—Peter D. Rosenberg
*Attorney, Agent, or Firm*—Farley, Forster and Farley

[57] ABSTRACT

A refining means for obtaining high duty spheroidal graphite cast iron through heating molten pig iron in an arc furnace to above the decomposition temperature of silicon oxide in the presence of carbon, such as 1500°C, whereupon a refining agent containing quick lime, graphite powder, calcium silicate, and calcium carbonate is allowed to react in refining through deoxidation and de-sulphurization.

11 Claims, 5 Drawing Figures

1540°C

1595°C

1660°C

1720°C

METHOD OF PRODUCING HIGH DUTY CAST IRON

BACKGROUND OF THE INVENTION

Heretofore, there have been developed various means for obtaining high duty cast iron, i.e., spheroidal graphite cast iron, including a refining method using a slag containing oxides, cyanides, carbonates and fluorides of alkali metals and alkaline earth metals and/or lime nitrogen; a treatment method using $MgF_2$ and/or $CaSi_2$; a treatment method using $AlF_2$, $CdF_2$ and/or $ZnF_2$; and a treatment method using lime silicide, lime fluoride and/or Mg-containing silicon iron. These conventional means, however, use fluorides to lower the melting point of the slag, which means that disposal of the slag in its non-treated condition cannot be effected without involving problems of environmental pollution. Technically, each means applies desulfurization and spheroidization treatments, but these treatments do not necessarily provide stabilized results depending upon the conditions involved. Further, they require troublesome operations.

SUMMARY OF THE INVENTION

In view of the above, in obtaining spheroidal graphite cast iron, the present invention is intended to obtain high duty cast iron which partly contains spheroidal graphite, by simple refining means without using fluorides or applying spheroidization treatment using Mg or other elements. The invention is characterized in that after molten pig iron is heated to above the temperature at which $SiO_2$ will decompose in the presence of C, a refining agent containing 10 – 90% CaO, 5 – 30% graphite powder, 5 – 20% Ca-Si and the balance $CaC_2$ is allowed to react in the attained temperature region, thereby providing high duty cast iron having spheroidal graphite contained in part of its structure, without applying spheroidization treatment using Mg or other elements.

According to the method of the present invention, molten metal from a separate furnace is charged into an arc furnace such as a batch arc furnace or a stock is directly melted in this arc furnace to provide molten pig iron, which is then heated to above the temperature at which $SiO_2$ will decompose in the presence of C (about 1,450°C for ordinary cast iron), whereupon a refining agent containing 10 – 90% CaO (quick lime), 5 – 30% graphite powder, 5 – 20% Ca-Si particles and the balance $CaC_2$ (calcium carbide) powder is added to said molten pig iron in an amount of 2 – 10% on the basis of the latter and allowed to contactwise react, thereby carrying out the refining process including deoxidation and desulfurization.

DETAILED DESCRIPTION OF THE INVENTION

Figure 1:
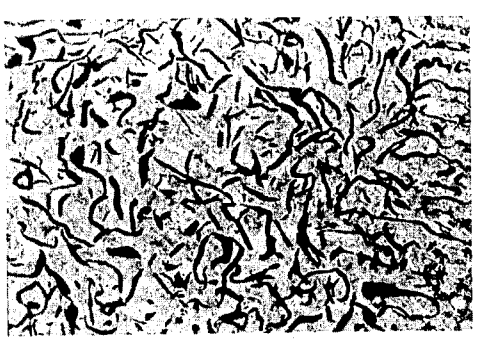
Figure 2:
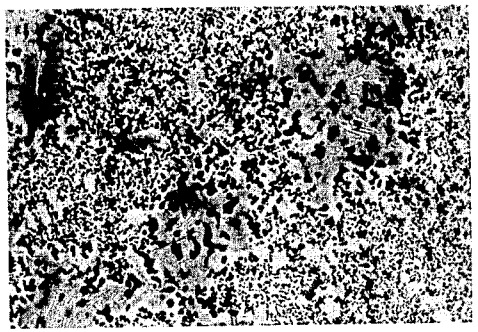
Figure 3:
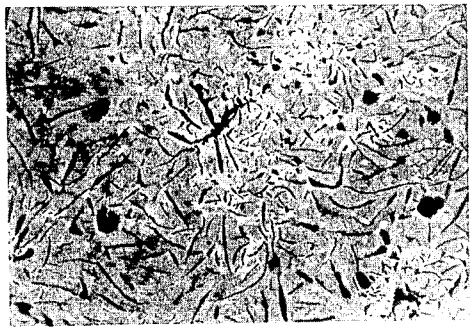
Figure 4:
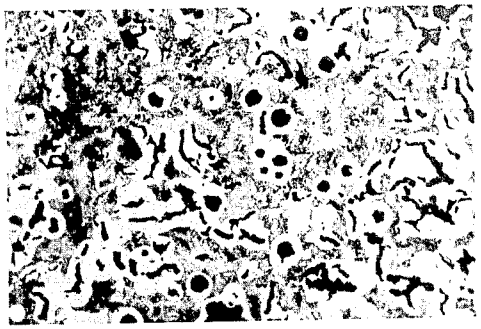
Figure 5:
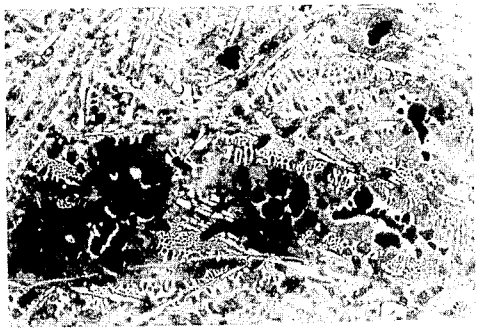

As for the respective functions of the constituents of said refining agent used in the present invention, CaO is employed for desulfurization and making of slag (adjustment of basicity), graphite for deoxidation (including decomposition of $SiO_2$), Ca-Si for deoxidation and $CaC_2$ for desulfurization and composition balance. In the present invention, since the refining agent consists mainly of graphite and CaO as described above, the melting point of the slag is high. Therefore, the refining temperature should be as high as at least 1,500°C to ensure that the slag will maintain its fluidity so that its contactwise reaction with the molten metal will satisfactorily take place, while the deoxidation reaction due to the graphite contained in the molten metal and the added graphite will be vividly accelerated.

The spheroidal graphite growth mechanism according to the above-mentioned refining method of the present invention will now be described.

The refining agent in molten fluidized condition contacts the molten metal heated to above the $SiO_2$ decomposition temperature as described above, so that deoxidation and desulfurization reactions proceed in the manner of interfacial reaction as assisted by the respective functions of the constituents of the refining agent. Further, since the refining temperature is relatively high or at least above the $SiO_2$ decomposition temperature, new $SiO_2$ will be prevented from being formed which would otherwise be formed as soon as the $SiO_2$ in the molten metal reacts with C and is decomposed, such $SiO_2$ being said to form the nucleus of flake graphite.

With the passage of refining time, the molten metal temperature rises and the contact reaction between the refining agent and the molten metal further proceeds until the S content of the molten metal is less than 0.005% and the $O_2$ content is less than 10ppm.

Simultaneously therewith, the CaO and MgO in the refractory material of the furnace are more or less reduced, and by the action of the Ca-Si in the refining material, the graphite structure is transformed from flake to eutectic and then to vermicular graphite mixed with fine particulate or spheroidal graphite. Further refining operation results in inverse chill. As shown in the following table, these changes in graphite structure depend on the refining temperature (and eventually on the degree of deoxidation and desulfurization). In addition, the refining agents used in experiment Nos. 2 – 5 in the following table consist of 30% CaO, 10% Ca-Si, 10% graphite powder and the balance $CaC_2$.

Table 1.

| Examples of Refining of Molten Metal | | | | | | | | | | |
|---|---|---|---|---|---|---|---|---|---|---|
| | Refining | | Composition (%) | | | | | | 30Φ sand-molded round bar tensile test | |
| Experiment No. | Temperature | Time | C | Si | S | Mg | $O_2$ | Graphite Structure | Tensile Strength | Elongation |
| | | | | | | | ppm | | Kg/mm² | % |
| 1 | Untreated | | 3.38 | 1.72 | 0.084 | 0.006 | 51 | Flake | 22.1 | 0.4 |
| | °C | min | | | | | | | | |
| 2 | 1540 | 30 | 3.59 | 1.76 | 0.006 | 0.018 | 13 | Fine particulate | 28.4 | 1.0 |
| 3 | 1595 | 30 | 3.66 | 1.80 | 0.004 | 0.021 | 8 | Flake + spheroidal | 30.7 | 2.2 |
| 4 | 1660 | 30 | 3.68 | 1.77 | 0.003 | 0.020 | 6 | Vermicular + spheroidal | 38.5 | 4.6 |
| 5 | 1720 | 30 | 3.73 | 1.84 | 0.003 | 0.022 | 6 | Spheroidal + | 18.6 | 0.6 |

Table 1.-continued

| Examples of Refining of Molten Metal | | | | | | | | | | |
|---|---|---|---|---|---|---|---|---|---|---|
| | Refining | | Composition (%) | | | | | | 30Φ sand-molded round bar tensile test | |
| Experiment No. | Temperature | Time | C | Si | S | Mg | $O_2$ | Graphite Structure | Tensile Strength | Elongation |
| | | | | | | | | cementite | | |

DESCRIPTION OF THE PHOTOMICROGRAPHS

In the attached photomicrographs in lieu of drawings, FIG. 1 is a micrograph (magnification: × 100) of untreated sample of No. 1 referred to in Table 1. Similarly, FIGS. 2 through 5 are micrographs (magnification: × 100) of samples Nos. 2 through 5, respectively, referred to in Table 1.

DESCRIPTION OF PREFERRED EMBODIMENTS

As has been already clear from the above description, the basic feature of the method of the present invention resides in deoxidation, desulfurization and decomposition of $SiO_2$. The reasons for selection of the particular amount of the refining agent to be added and the particular proportions of its constituents, which bring about such results will now be described.

As for the amount of refining agent added to molten metal being restricted to 2 – 10%, it is desirable that the amount to be added vary according to the type of the furnace used for refinement. For example 4 – 5% is suitable for batch arc furnaces, 2 – 5% for continuous refining furnaces in view of some amount of residue, and 5 – 10% is suitable in the case where the refining agent is repetitively used in a batch arc furnace having a great depth of molten metal. As for the specification and proportions of the refining agent, since molten pig iron from a blast furnace, electric furnace or cupola is used in the present invention, 10 – 90% CaO is necessary in the case of the total amount of refining agent with respect to said molten metal in order to secure a sufficient degree of basicity (desirably, $CaO/SiO_2 = 2$ or above) to neutralize about 0.2 – 5% $SiO_2$ from said furnace with CaO and to cause deoxidation to take place. In order to remove the oxygen in the suspension $SiO_2$ and in other substances in the form of CO, it is necessary to ensure that the carbon content of the molten metal will act as a deoxidizing agent at high temperatures. In this connection, it is desirable that graphite powder, which assists in this action, be added in an amount of 5 – 30%, as has been ascertained by the experimental results of the present method including those shown in Table 1. In this case, the amount below 5% would not be very effective while the amount above 30% would result in excessive carburization, which is not desirable from the standpoint of cast iron composition. Further, it has also been ascertained that the addition of about 5 –20% Ca-Si is very effective to further assist in said action while serving as a Ca supply source. Finally, in order to provide for balance for the compounding of constituents, use is made of $CaC_2$, which is useful and harmless in connection with removal of oxygen and sulfur.

The functions of the above-mentioned constituents are greatly influenced by temperature, and theoretically, they vary with the amount of carbon. However, it is desirable that these constituents act at temperatures above the decomposition temperature of $SiO_2$ (about 1,450°C for ordinary cast iron). More desirably, they should be maintained above 1,500°C where the viscosity of the refining agent, which is another factor of reaction, becomes satisfactory. Further, at such high temperatures, a synergistic effect can be expected in which CaO in the refining agent reacts with C to form $CaC_2$, thus providing a strong reducing condition which accelerates deoxidation. In addition, flux, if used, can be expected to be effective as a viscosity improving agent, but this is not the essential action.

While an arc furnace is used in the above embodiment, it is also possible to use a converter to elevate the temperature of the molten metal by oxygen blowing.

For example, molten pig iron from a blast furnace, containing 4.2%C, 7% SiO, 0.046%S and 45ppm $O_2$ was heated in a converter by oxygen blowing, using about 30mm3 of oxygen per ton of pig iron, until the pig iron reached a CO boiling condition at 1,770°C and the impurities therein were 2.7%C, 0.0%Si and 0.043%S. 0.8% Fe-Si and 3% refining agent of the invention were added and allowed to react for about 5 minutes with mechanical stirring, resulting in 3.65% C, 1.68% Si, 0.004% S and 7 ppm $O_2$. Casting was then performed under the same conditions as in Table 1, providing a graphite structure which is eutectic + spheroidal + vermicular. It showed a tensile strength of 37.5Kg/mm$^2$ and an elongation of 2.1%.

The refined iron of the present invention may be used as high duty cast iron in its refined condition as described above, but if it is used to make spheroidal graphite cast iron, the following distinct advantages will be obtained.

Since spheroidal graphite has already been crystallized, the necessary amount of spheroidizing agent to be added is very small. Further, it can be added in a very simple manner: for example, a pre-placement casting method (in which the spheroidizing agent is first placed in a mold and molten metal is then poured into the mold) may be employed. Therefore, both additive Mg and residual Mg are very small in amount as compared to the conventional method, and in the case of pure Mg, amounts which are less than 0.04% are sufficient for spheroidization. Therefore, the carbide stabilizing action by magnesium or by oxygen left unremoved by magnesium is decreased in amount, so that the casting becomes easily ferritized in its as-cast condition, having almost no casting defects such as dross and shrinkage cavity. Of course, ferritization satisfactorily proceeds with less amount of Si than usual. The following Table 2 shows examples of making spheroidal graphite cast iron using refined molten metal according to the present invention.

Table 2.

| NO. | Spheroidizing agent | Spheroidizing treatment | Examples of Making Spheroidal Graphite Cast Iron Using Refined Molten Metal Composition | | | | | | Structure | | Strength | |
|---|---|---|---|---|---|---|---|---|---|---|---|---|
| | | | C | Si | Mn | P | S | Mg | Spheroidization | Ferrite | Tensile strength | Elongation |
| | | | | | | | | | % | % | Kg/mm² | % |
| 1 | 0.8% of 3% Mg added | pre-placement casting | 3.46 | 2.23 | 0.27 | 0.044 | 0.006 | 0.034 | 85 | 95 | 47.9 | 16.2 |
| 2 | 1.2% of 1.5% Mg added | pre-placement casting | 3.51 | 2.30 | 0.26 | 0.048 | 0.005 | 0.033 | 85 | 98 | 45.8 | 19.4 |
| 3 | 0.035% of pure Mg added | addition under pressure | 3.52 | 2.28 | 0.25 | 0.046 | 0.006 | 0.032 | 85 | 93 | 51.0 | 15.9 |

(Nos. 1 and 2; Y-block specified by JIS G 5502 A)
(No. 3; 250Φ × 500'pipe)

As has been described thus far, the refining method of the invention is greatly simplified as compared to the conventional methods and yet it is capable of dependably and stably producing high duty cast iron partly containing spheroidal graphite. Without the need to apply any special desulfurizing or spheroidizing treatment, the molten metal is heated to a temperature above the decomposition temperature of $SiO_2$ and the particular refining agent is allowed to contactwise react in that temperature region, whereby deoxidation, desulfurization and $SiO_2$ decomposition satisfactorily proceed. Thus, there is obtained high duty cast iron suitable as a material for products including a spheroidal graphite cast iron and ferrite-containing spheroidal graphite cast iron articles which may be in their as-cast condition.

We claim:

1. A method of producing high duty cast iron comprising heating molten pig iron to above the temperature at which $SiO_2$ will decompose in the presence of C, forming a slag on the surface of said molten pig iron by adding a refining agent consisting essentially of 10–90-%CaO, 5–30% graphite, 5–20%Ca-Si and the balance $CaC_2$, allowing said refining agent to react in contact with said pig iron under said temperature condition, thereby de-oxidizing and de-sulphurizing said pig iron to produce refined iron.

2. A method of producing spheroidal graphite cast iron having ferritic structure in its as-cast condition, comprising adding a spheroidizing agent, such as magnesium to the molten refined iron produced by the method set forth in claim 3.

3. A method of producing high duty cast iron comprising heating molten pig iron to above the temperature at which $SiO_2$ will decompose in the presence of C, allowing a refining agent consisting essentially of 10–90% CaO, 5–30% graphite, 5–20%Ca-Si and the balance $CaC_2$ to react in contact with said pig iron under said temperature condition, thereby producing refined iron which in the cast condition has spheroidal graphite in part of the structure.

4. A method as set forth in claim 3, wherein the molten pig iron is heated to above 1,5000°C and under this temperature condition said refining agent is allowed to react.

5. A method as set forth in claim 4 wherein 2 – 10% of the refining agent is added to the molten pig iron and allowed to react.

6. A method as set forth in claim 3 wherein 2 – 10% of the refining agent is added to the molten pig iron and allowed to react.

7. A method as set forth in claim 2 wherein an amount of magnesium spheroidizing agent in the range of 0.035 to 1.2% is added.

8. A method as set forth in claim 2 wherein an amount of pure magnesium spheroidizing agent in the range under 0.04% is added.

9. A method as set forth in claim 3 wherein heating in an arc furnace for a time in the order of 30 minutes is employed in refining the molten pig iron.

10. A method as set forth in claim 3 wherein heating in an oxygen converter at a temperature in the order of 1770°C for a reaction time in the order of 5 minutes with mechanical stirring is employed in refining the molten pig iron.

11. A method as set forth in claim 3 wherein proportions in the order of 30% CaO, 10% Ca-Si, 10% graphite powder and the balance $CaC_2$ are employed in the refining agent.

* * * * *

UNITED STATES PATENT AND TRADEMARK OFFICE

CERTIFICATE OF CORRECTION

PATENT NO. : 3,954,446

DATED : May 4, 1976

INVENTOR(S) : Tadashi Miyaoka, Hiromu Tanimura, Yoshio Tanaka, Susumu Togawa

It is certified that error appears in the above-identified patent and that said Letters Patent are hereby corrected as shown below:

Column 4, line 36, "0.043%S." should read --0.043%S, whereupon--

Column 6, line 23, "1,5000°C" should read --1,500°C--

Signed and Sealed this

Seventh Day of September 1976

[SEAL]

*Attest:*

RUTH C. MASON
*Attesting Officer*

C. MARSHALL DANN
*Commissioner of Patents and Trademarks*